US006063225A

United States Patent [19]

Riordan

[11] Patent Number: 6,063,225

[45] Date of Patent: May 16, 2000

[54] METHOD OF DISPENSING SHEET MARKER TABS

[75] Inventor: James F. Riordan, Cameron Park, Calif.

[73] Assignee: 3M Innovative Properties Company, Saint Paul, Minn.

[21] Appl. No.: 09/038,865

[22] Filed: Mar. 11, 1998

Related U.S. Application Data

[63] Continuation of application No. 08/343,360, Nov. 22, 1994, abandoned, which is a continuation of application No. 08/084,748, Jun. 29, 1993, abandoned, which is a continuation of application No. 07/870,795, Apr. 17, 1992, abandoned, which is a continuation of application No. 07/583,784, Sep. 17, 1990, abandoned.

[51] Int. Cl.[7] ..... B32B 31/00

[52] U.S. Cl. ..... 156/250; 156/256; 156/269; 156/270; 428/189; 428/192; 427/284; 427/286; 427/208.4; 206/411

[58] Field of Search ..... 156/269, 270, 156/256, 250; 427/284, 285, 286, 208.4; 428/192, 354, 906, 189; 225/56, 91; 206/411; 40/641

[56] References Cited

U.S. PATENT DOCUMENTS

| | | | |
|---|---|---|---|
| 1,883,421 | 10/1932 | Stevens | 428/40.4 |
| 2,142,194 | 1/1939 | Karfiol | 206/447 |
| 2,170,147 | 8/1939 | Lane | 206/447 |
| 2,307,406 | 1/1943 | Howard | 156/199 |
| 2,346,219 | 4/1944 | Johnson | 40/638 |
| 2,808,358 | 10/1957 | Masse | 156/248 |
| 3,001,306 | 9/1961 | Wilkinson | 40/641 |
| 3,032,181 | 5/1962 | Hutter | 428/192 |
| 3,193,433 | 7/1965 | Tillotson | 156/381 |
| 3,444,635 | 5/1969 | Setzler | 40/641 |
| 3,747,242 | 7/1973 | Heimann | 40/641 |
| 4,223,058 | 9/1980 | Citron | 428/189 |
| 4,438,950 | 3/1984 | Hamisch, Jr. | 283/70 |
| 4,617,199 | 10/1986 | Galli et al. | 427/208 |
| 4,680,210 | 7/1987 | Corcoran | 428/42.3 |
| 4,907,825 | 3/1990 | Miles et al. | 281/51 |
| 5,040,713 | 8/1991 | Wang et al. | 225/16 |
| 5,090,565 | 2/1992 | Wang | 206/411 |
| 5,153,043 | 10/1992 | Wang | 428/42.3 |

FOREIGN PATENT DOCUMENTS

| | | |
|---|---|---|
| 1048972 | 2/1979 | Canada . |
| 1132110 | 3/1957 | France . |
| 28 00 939 | 8/1978 | Germany . |
| 89 05 144 | 6/1989 | Germany . |
| 757 587 | 9/1956 | United Kingdom . |
| 2013613 | 8/1979 | United Kingdom . |
| WO 80/02391 | 11/1980 | WIPO . |
| WO 93/22389 | 11/1993 | WIPO . |

*Primary Examiner*—Richard Crispino
*Assistant Examiner*—Linda L Gray
*Attorney, Agent, or Firm*—Michaele A. Hakamaki

[57] ABSTRACT

A tape roll structure which includes a tape having adhesive on one face, and the tape can be pulled off a tape roll and cut into segments of varying lengths. The tape is provided with a paper tape or coating on one or both sides for receiving written indicia, and which becomes part of a tape segment. Thus, once a tape segment has been attached by adhesive to a marginal edge of a sheet, written indicia can be written on the paper tape or coating so that a tab is immediately formed on a sheet. In a preferred embodiment, a pair of tape rolls are mounted in a shell, and one of the tape rolls carries a paper tape and the other tape roll carries adhesive tape. When the two tapes are pulled from their rolls, the paper tape moves into bonded engagement with one-half of the adhesive tape of the other roll. Then the tapes are cut into a segment and bonded to the sheet to which a tab is to be mounted.

9 Claims, 2 Drawing Sheets

METHOD OF DISPENSING SHEET MARKER TABS

This application is a continuation of application Ser. No. 08/343,360, filed Nov. 22, 1994, (abandoned), which is a continuation application Ser. No. 08/084,748, filed Jun. 29, 1993 (abandoned), which is a continuation of application Ser. No. 07/870,795, filed Apr. 17, 1992, (abandoned), which is a continuation of application Ser. No. 07/583,784. filed Sep. 17, 1990, (abandoned).

BACKGROUND OF THE INVENTION

This invention relates to improvements in flexible adhesive tape for attachment to surfaces of sheets and other objects and, more particularly, to tape roll structure for use in making tabs on an edge margin of a sheet.

Conventional tabs for edge margins of sheets are typically made of plastic which is transparent, and each tab has a pocket for receiving a paper strip on which indicia can be written before the paper strip is inserted into the pocket. The conventional tabs are costly, relatively rigid, limited in length, and are bonded in some suitable manner to an edge margin of a sheet to couple the paper strip to the sheet.

It is a cumbersome and laborious task to couple the conventional plastic tab holder to a sheet. It is desirable that the use of a tab be made easier and less expensive and that the length of the tab be variable; thus, improvements are needed to simplify not only the making of tabs, but also the placement of tabs on the edge margins of sheets. The present invention provides such improvements.

SUMMARY OF THE INVENTION

The present invention provides a tape roll structure which includes a transparent or a translucent tape having adhesive on one face thereof, and the tape can be pulled off a tape roll and cut into a segment in a normal fashion. The tape of the present invention can be provided with means for receiving written indicia, and such means is cut when the tape is cut. The indicia receiving means thus becomes part of the tape segment. Thus, once a tape segment has been attached by adhesive to a marginal edge of a sheet, the indicia can be written or otherwise marked on the receiving means so that a tab is immediately formed on a sheet. Other tabs can be coupled in a like manner to other sheets. The present invention thus provides means for forming tabs for sheets in a manner to avoid the time-consuming and costly drawbacks of conventional tab-forming structures and allows indicia of variable lengths.

In a preferred embodiment of the invention, a pair of tape rolls are mounted in a shell, and one of the tape rolls is made up of a paper tape while the other tape roll is made up of an adhesive tape. When the two tapes are pulled together away from their rolls, the paper tape moves off its roll and into bonded engagement with a part of, e.g., one-half of, the adhesive tape of the other roll. Then the tapes, when bonded together, are cut into a short segment and the other part of the cut segment of the adhesive tape can be immediately bonded to the sheet to which a tab is to be mounted. The paper tape of each segment is written on to receive the indicia which designates or identifies the sheet on which the tab is mounted.

Another embodiment of the present invention is a single roll of tape which can be provided with a coating on one or both sides of part of or one-half of the tape, the coating being capable of receiving written indicia. The other half of the tape is provided with adhesive for bonding the tape to a sheet to receive a tab.

In another embodiment of the single tape roll concept, the tape roll is comprised of two tapes wound together about the same central axis, one tape being an adhesive tape and the other tape being a paper tape with the paper tape being the tape to receive the written indicia. The paper tape is bonded directly to part of or one-half of the adhesive tape, and the adhesive tape is secured to the backside of the sheet to which a tab is to be mounted. The tab can be thus formed in a minimum of time and with a minimum of effort from the tape roll structure.

The present invention provides an adhesive-backed tape which can be provided with a coating in white or other color and which will accept and retain ink from a pen or typewriter, or lead from a pencil, and which may be pulled out from a tape roll structure and cut into segments of any desired length in the same manner as conventional Scotch-brand tape is cut. Each tape segment can easily and quickly be secured to the rear side of a sheet of paper or other material to form a permanent or removable tab for easy identification and location of a sheet when placed in hanging files or manila folders or when using the sheet as a binder divider. The tabs may contain writing or be used as a color coded system.

The present invention provides tape structure which may be dispensed from a pre-rolled form in which the tab feature has been incorporated into the roll at the factory, directly from a standard ¾ inch Model C15 Scotch brand dispenser or equivalent. The present invention may also be dispensed from a shell-like cartridge which drops into the well or groove of a conventional tape dispenser base, and which operates to laminate standard adhesive tape to paper strips at the point of cutoff of the tape into segments.

The present invention contemplates that a single tape roll can be manufactured with a paper tape incorporated with the adhesive tape of the tape roll or the adhesive tape can be provided with a coating on one-half of the width of the adhesive tape on one or both sides. The coating can be with a white or colored. The advantage in providing the coating is the ease of production and the symmetry of the flatness across the width of the tape, allowing the tape roll to be uniform in thickness across the width of the tape and allowing more tabs to be available from a single tape roll. A minor disadvantage is that the tabs would lack the stiffness inherent in the design which incorporates a paper tape.

The tape segments can be used to form marginal edge tabs, and the segments can be quickly placed on several or all documents or sheets of paper in one file folder. Thus, individual letters or documents with the tape segments on them can be quickly identified without searching through the files.

The tabs formed by the present invention are of substantially the same thickness as the sheet on which the tabs are mounted. The tabs lay flat in a copy machine and roll easily into a typewriter. The tabs allow copies to be made quickly and easily. Copies are distortion-free since the original sheets lay flat on the copier glass. This is not possible with standard plastic or glue-on tabs. Since the tab of the present invention is taped on a sheet from the reverse side of the sheet, the tab does not show up on the copies made from an original with a tab. The tabs of the present invention can be placed on the side or top of a sheet and then put into a typewriter for text to be typed on, providing a professionally finished product in applications where hand-written messages would not be unacceptable. Messages can also be written or typed on both sides of the tab.

Tabs can be available at all times from the tape roll structure on a desk top, and the tabs can be quickly and easily cut to size, such as cutting the size of a piece of conventional adhesive tape.

Other objects of this invention will become apparent as the following specification progresses, reference being had to the accompanying drawings for illustrations of several embodiments of the invention.

DESCRIPTION OF THE SPECIFIC EMBODIMENT

Figure 1:
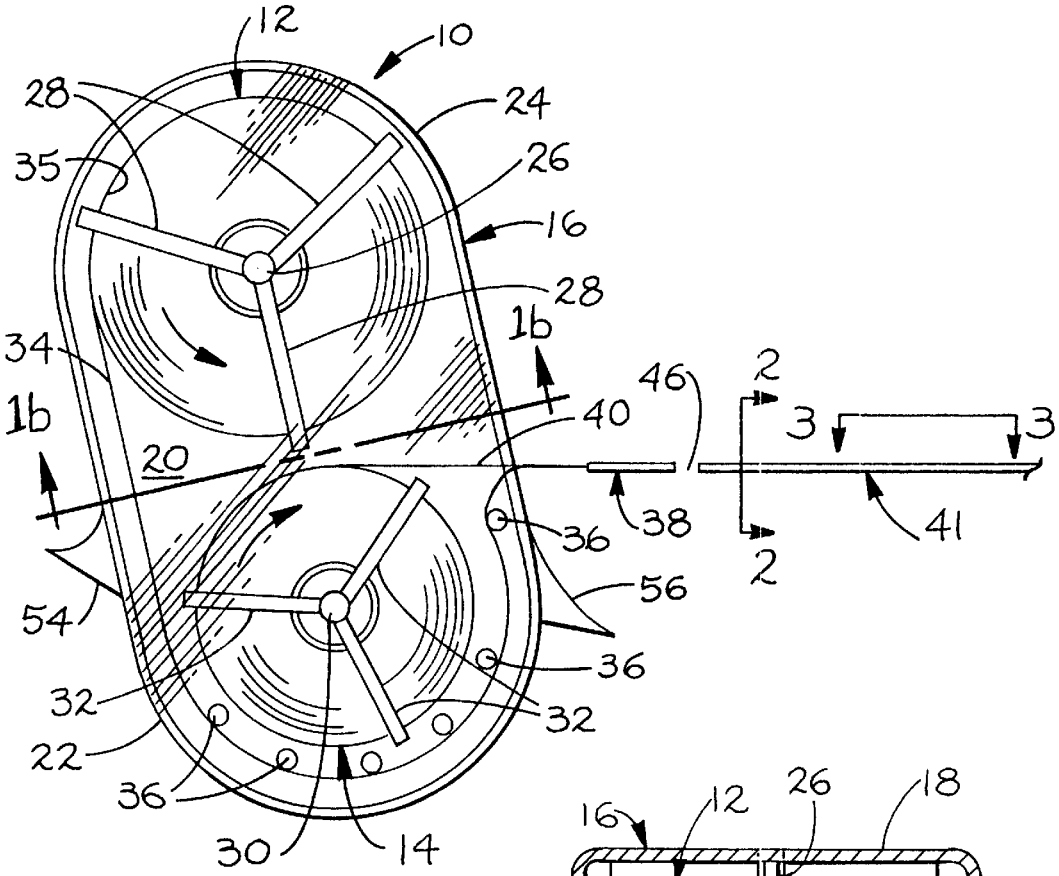
FIG. 1 is a side elevational view of a tape roll structure forming one embodiment of the present invention, and showing two coupled tapes pulled outwardly from the structure.

A first embodiment of the tape roll structure of the present invention is denoted by the numeral 10 and includes a rotatable tape roll 12 and a rotatable tape roll 14 spaced from tape roll 12. Tape roll 14 is rotatable about an axis parallel with the axis of rotation of tape roll 12. The two tape rolls 12 and 14 are remounted in a shell 16 (FIGS. 1 and 1B), the shell having opposed sidewalls 18 and 20 (FIG. 1B) and a pair of opposed end walls 22 and 24. The shell is made so that walls 18 and 20 can be separated to allow replacement of either or both of tape rolls 12 and 14 when a tape supply on the roll or rolls is depleted.

Tape roll 12 has a shaft 26 mounted by radial webs 28 on sidewalls 18 and 20 so that the tape roll 12 can rotate about the axis of shaft 26. Similarly, a shaft 30 mounts tape roll 14 on radial webs 32 coupled to shell 16 so that tape roll 14 can rotate about an axis parallel with the axis of shaft 26.

Figure 1B:
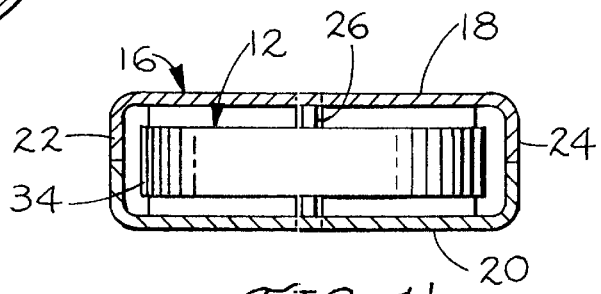
FIG. 1B is a cross-sectional view taken along line 1B—1B of FIG. 1.

While tape rolls 12 and 14 can rotate in either direction, tape roll 12 is designed to rotate in a counterclockwise sense when viewing FIG. 1 and tape roll 14 is designed to rotate in a clockwise sense when viewing FIG. 1.

Tape roll 12 is formed from a number of convolutions or windings of paper tape 34 on an outer peripheral web 35 surrounding shaft 26. Tape 34 extends away from tape roll 12 and extends downwardly about spaced pins 36 in shell 16 which serve as tape guides to direct the paper tape 34 to a location denoted by the numeral 38 where the tape 34 comes in contact with and merges with a tape 40 from tape roll 14. Tape 40 is provided on the lower face thereof with a layer of adhesive so that the paper tape 34 will bond to only a part of the width of tape 40. Tape 34 is typically one-half the width of the tape 40 so that tape 34 is applied to tape 40 along a side portion having one-half of the width of tape 40 when the two tapes 34 and 40 meet near location 38.

Figure 2:
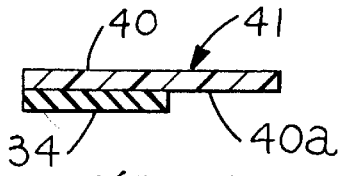
FIG. 2 is an enlarged cross-sectional view taken along line 2—2 of FIG. 1.
Figure 3:
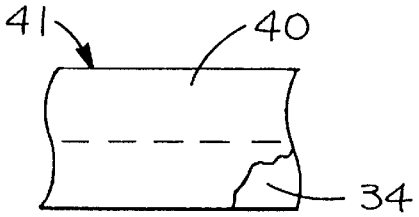
FIG. 3 is a top plan view of a tape segment looking in the direction of line 3—3 of FIG. 1.
Figure 4:
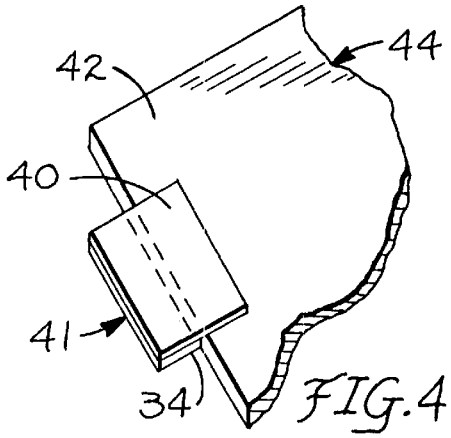
FIG. 4 is a fragmentary, perspective view of a sheet with the tape segment of FIG. 3 coupled to the rear face of the sheet.
Figure 5:
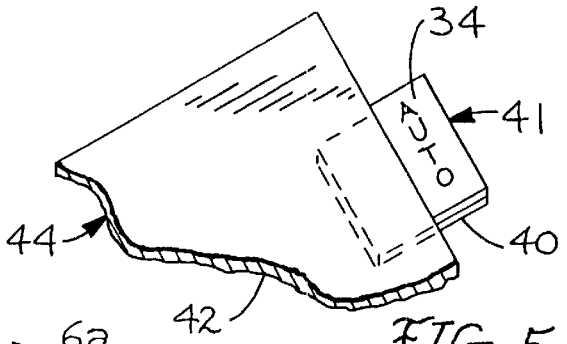
FIG. 5 is a view similar to FIG. 4 but showing the tape segment showing the front face of the means thereon for receiving written indicia.

FIGS. 2 and 3 show a tape segment 41 formed when paper tape 34 is bonded to the lower face of adhesive tape 40 with the width of paper tape 34 being substantially equal to one-half the maximum width of tape 40, the lower face 40*a* which is not covered by paper tape 34 being still provided with an adhesive so as to bond to the rear face 42 of a sheet 44, such as a plastic or paper sheet 44 as is shown in FIGS. 4 and 5. The tape segment 41 will be bonded to sheet 44 in a manner to expose one surface of paper tape 34 included in tape segment 41 (see FIG. 5) as in a position to receive written indicia, such as letters, numbers, words and the like. Tape segment 41, therefore becomes a tab automatically when the tape segment is cut from tapes 34 and 40, such as at the breakpoint 46 (FIG. 1) by a cutter blade 60 carried by base 50.

Figure 1A:
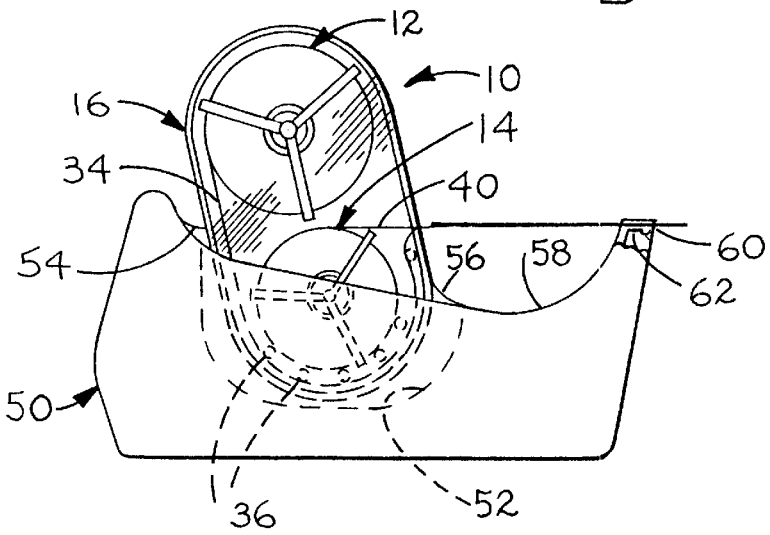
FIG. 1A is a view similar to FIG. 1 but showing the tape roll structure in the well of a base.

Tape roll structure 10 is adapted to be placed in a conventional base 50 (FIG. 1A) having a groove or well 52 for receiving the lower portion of tape roll structure 10 as shown in FIG. 1A. A pair of projections 54 and 56 are provided on shell 16, and these projections rest on the upper surface 58 of base 50 so as to support the shell 16 and thereby tape rolls 12 and 14 in the manner shown in FIG. 1A. Serrated cutting blade 60 is provided at the outer end of the base for cutting the two tapes 34 and 40 at breakpoint 46 after the tapes have been manually pulled past and onto a flat, upper, horizontal surface 62 on the base. Shell 16 can be lifted out of well 52 for replacement of tape rolls 12 and 14 at any time.

The tapes 34 and 40 are flexible and can easily be cut. Tape 40 can be transparent or translucent and have adhesive on the entire lower face thereof.

Figure 6:
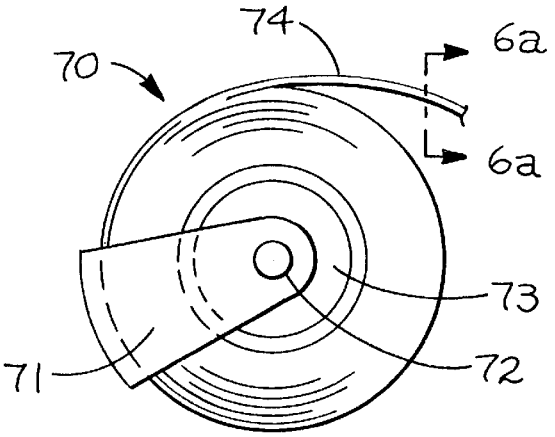
FIG. 6 is a side elevational view of a tape roll forming a second embodiment of the present invention.
Figure 6A:
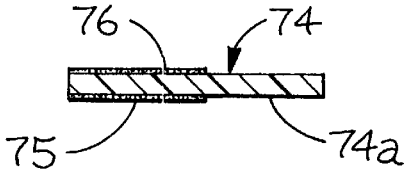
FIG. 6A is a cross-sectional view taken along the line 6A—6A of FIG. 6.

Another embodiment of the tape roll structure of the present invention is broadly denoted by the numeral 70 and comprises a single roll of tape which is mounted for rotation by web structure 71 in any suitable manner on a support, the web being used to mount a shaft 72 on which a center disk 73 is rotatably mounted. The tape structure in the form of a plastic adhesive tape 74 is wound on disk 73, and tape 74 has a coating of white or colored paint, the coating being denoted (FIG. 6A) by the numeral 75, on the lower face of the tape adjacent to a layer of adhesive on the lower face 74*a* of tape 74. A second coating 76 of paint can be on the upper face of tape 74, if desired, directly above coating 75. The coating 75, when the tape is to be used, can be written on, such as by a pen or pencil, and the tape segment, of any length, formed when the tape is cut in a suitable manner, such as by a scissors or by a blade, such as blade 60 of the embodiment 10, can be used to form an end tab for a sheet such as sheet 44 (FIGS. 4 and 5).

Figure 6B:
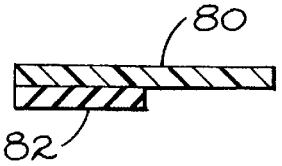
FIG. 6B is a view similar to FIG. 6A but showing a tape segment formed from another embodiment of the tape roll structure of the present invention.

As is shown in FIG. 6B, another embodiment of the tape for the tape roll structure 70 includes an adhesive tape 80 with a paper tape 82 forming the means for receiving written indicia. Paper tape 82 is bonded to the lower surface of tape 80 so that the tape roll structure 70 includes adhesive tape 80 with paper tape 82 wound thereon to form a finished tape roll structure whose tape to be dispensed is initially wound as two tapes on two tape rolls. The two tapes come off the roll attached together and remain coupled together when the tapes are cut into segments to form tabs to be bonded to the edge margins of sheets.

What is claimed is:

1. A method of dispensing sheet marker tabs comprises:

providing a roll of tab forming tape, the tape having a first major side and a second major side, first and second longitudinally side-by-side separate portions defined on the tape, a coating capable of receiving indicia thereon extending along the first portion on at least one of the sides of the tape, a layer of adhesive extending only along the second portion on one of the sides of the tape, the second portion being light transmissive, and the first portion including the coating and the second portion including the layer of adhesive having a uniform thickness measured normal to the sides across the width of the tape;

pulling a longitudinally extending length of the tab forming tape from the roll; and sequentially and transversely cutting the length of tape into a plurality of marginal edge tabs.

2. The method of claim 1, and further comprising:

placing the layer of adhesive on the second portion of each tape segment into bonded engagement with a selected sheet to be marked.

3. The method of claim 2, and further comprising:

aligning the tape segment relative to the selected sheet so that the first portion of the tape segment projects beyond an edge of the sheet to display the coating and any indicia thereon.

4. The method of claim 2, and further comprising:

applying indicia on the coating on the first portion of the tape segment adhered to the selected sheet.

5. The method of claim 2 wherein the layer of adhesive removably bonds the tape segment to the selected sheet.

6. The method of claim 1, and further comprising:

rotatably supporting the roll on a shaft;

defining a tape dispensing path for the tape being pulled from the roll; and aligning a cutting blade laterally across the tape dispensing path for use in the cutting step.

7. A method of dispensing sheet marker tabs comprises:

providing a roll of tab forming tape, the tape having a first major side and a second major side, first and second longitudinally extending separate portions defined on the tape, a first coating capable of receiving indicia thereon extending along the first portion on the first side of the side of the tape, a second coating capable of receiving indicia extending along the first portion on the second side of the tape, a layer of adhesive extending along the second portion on one of the sides of the tape, the second portion being light transmissive, and the first portion including the coating and the second portion including the layer of adhesive having a uniform thickness measured normal to the sides across the width of the tape;

pulling a length of the tab forming tape from the roll; and sequentially cutting the length of tape into a plurality of marginal edge tabs.

8. The method of claim 7, and further comprising:

applying indicia on at least one of the coatings.

9. The method of claim 8, and further comprising:

applying indicia on both of the coatings.

* * * * *